United States Patent [19]

Kohri et al.

[11] Patent Number: 4,868,082

[45] Date of Patent: Sep. 19, 1989

[54] BINDER TYPE CARRIER

[75] Inventors: Toshitaro Kohri; Junji Machida, both of Osaka, Japan

[73] Assignee: Minolta Camera Kabushiki Kaisha, Osaka, Japan

[21] Appl. No.: 149,163

[22] Filed: Jan. 27, 1988

[30] Foreign Application Priority Data

Jan. 29, 1987 [JP] Japan ..... 62-19177

[51] Int. Cl.[4] ..... G03G 9/14; G03G 9/10

[52] U.S. Cl. ..... 430/106.6; 430/108; 430/110

[58] Field of Search ..... 430/108, 110, 106.6

[56] References Cited

U.S. PATENT DOCUMENTS

| | | | |
|---|---|---|---|
| Re. 3072 | 11/1982 | Jadwin et al. . | |
| 3,533,835 | 10/1970 | Hagenbach et al. . | |
| 3,669,885 | 6/1972 | Wright et al. . | |
| 3,720,617 | 3/1973 | Chatterji et al. . | |
| 3,795,618 | 3/1974 | Kasper . | |
| 3,840,464 | 10/1974 | Van Engeland et al. . | |
| 3,873,356 | 3/1975 | Queener et al. . | |
| 3,898,170 | 8/1975 | Kasper . | |
| 3,916,065 | 10/1975 | Moriconi . | |
| 4,013,573 | 3/1977 | Leikhim et al. . | |
| 4,062,693 | 12/1977 | Berger . | |
| 4,265,995 | 5/1981 | Mammino | 430/106.6 |
| 4,493,855 | 1/1985 | Sachdev et al. . | |
| 4,517,268 | 5/1985 | Gruber et al. . | |
| 4,518,673 | 5/1985 | Noguchi et al. . | |
| 4,555,466 | 11/1985 | Okada . | |
| 4,600,675 | 7/1986 | Iwasa et al. . | |
| 4,609,603 | 9/1986 | Knapp . | |
| 4,672,016 | 6/1987 | Isoda et al. . | |

FOREIGN PATENT DOCUMENTS

| | | | |
|---|---|---|---|
| 1158090 | 12/1983 | Canada | 430/106.6 |
| 2725963 | 12/1977 | Fed. Rep. of Germany | 430/106.6 |
| 5937553 | 2/1971 | Japan . | |
| 57122449 | 12/1971 | Japan . | |
| 5969762 | 3/1975 | Japan . | |
| 6050543 | 4/1978 | Japan . | |
| 60107038 | 2/1979 | Japan . | |
| 57190957 | 3/1979 | Japan . | |
| 59201064 | 10/1979 | Japan . | |
| 55-28032 | 2/1980 | Japan | 430/106.6 |
| 60147750 | 7/1980 | Japan . | |
| 59223458 | 9/1981 | Japan . | |
| 60-170865 | 9/1984 | Japan . | |
| 59200262 | 11/1987 | Japan . | |
| 2083920 | 3/1982 | United Kingdom | 430/106.6 |

OTHER PUBLICATIONS

F. Lions, K. V. Martin, *Journal of the American Chemical Society,* 1957, 79 2733–2738.

*Primary Examiner*—Paul R. Michl
*Assistant Examiner*—Jeffrey A. Lindeman
*Attorney, Agent, or Firm*—Burns, Doane, Swecker & Mathis

[57] ABSTRACT

The present invention relates binder type carriers, the surface of which is firmly adhered with charge controlling agents, by which the elastic charge of the carriers can be controlled to a desirable polarity and a level without the influence of the chargeability inherent to the magnetic powders themselves.

10 Claims, No Drawings

BINDER TYPE CARRIER

BACKGROUND OF THE INVENTION

The present invention relates to a carrier suitable for a development by a magnetic brush.

Development of an electrostatic latent image can be effected by attracting a minus or plus toner frictionally charged on a plus or minus electostatic latent image formed on a photosensitive member respectively. In order to charge the toner a plus or minus charged carrier is used. If the carrier can be optionally varied in its polarity of charge, one kind of neutral toner can be used as a toner chargeable to both plus and minus polarities.

Hitherto, as methods of changing the polarity of charge on a binder type carrier there are disclosed in Japanese Patent Publication (KOKAI) No. 6660/1986 that various kinds of charge controlling agents are incorporated into a binder resin (First method), and in Japanese Patent Publication (KOKAI) No. 100242/1978 and Japanese Patent Publication (KOKAI) No. 79634/1979 that the surface of magnetic powders or the like is coated with a resin containing charge controlling agents (Second method).

In the first method the effect of the charge controlling agent is negligible, because the content of the magnetic powder in the carrier is too much (200 to 900 parts by weight) in comparison with the toner content, so that the magnetic powder strongly influence the polarity of the carrier even if the charge controlling agents are incorporated into the binder resin.

In the second method, as when the binder type carrier is coated with a coating resin containing charge controlling agents or a solution containing them, the carrier is dissolved by the coated resin or a solvent in the solution, the application of the second method to the binder type carrier is substantially impracticable. Therefore, this method is usually applied to inorganic magnetic powder such as iron powder, magnetite powders, ferrite powder and the like or other carriers having a core of material insoluble with solvent, for example glass core. Thus, the second method is not suitable for binder type carriers.

SUMMARY OF THE INVENTION

The present invention provides a binder type carrier usable for development by magnetic brush, which can be controlled in the polarity of charge. The binder type carrier of the present invention is produced by adhering charge controlling agents on the surface of the core essentially consisting of magnetic powders and thermoplastic resins.

DETAILED DESCRIPTION OF THE INVENTION

The present invention relates to binder type carriers which comprise cores essentially consisting of magnetic powders and thermoplastic binder resins, and charge controlling agents adhered on the surface of the cores.

The binder type carriers of the present invention can be prepared by firmly adhering charge controlling agents on the surface of cores which are conventional binder type carriers essentially consisting of thermoplastic binder resins and magnetic powders.

The cores used in the present invention may be a well known one, for example, the binder type carrier as described in Japanese Patent Publication (KOKAI) No. 66134/1979, in which magnetic powders having a particle size of from 0.01 to 2 micron meters are dispersed in binder resins and bound therein. The descriptions in the specifications for the above patent applications are incorporated into the present invention. A preferable binder type carrier to the present invention has a particle diameter of from 20 to 100 micron meters, especially 50 to 70 micron meters.

The magnetic powders dispersed in the binder resins may be any one having a volumetric specific resistance of more than $10^4$ ohm cm, and a magnetization intensity of from 40 emu/g to 90 emu/g, especially from 60 emu/g to 80 emu/g, which may include iron powders, ferrite powders, magnetite powders, and the like. Particle size of the magnetic powders may be from 0.01 to 2 micron meters, preferably from 0.05 to 1 micron meters.

The binder resins usable in the present invention include polymers having a polar group such as carboxy group, hydroxyl group, glycidyl group, amino group and the like, derived from acid monomer having a polymerizable unsaturated bond, for example, acrylic acid, methacrylic acid, maleic acid, itaconic acid, and the like; hydroxyl group-containing monomer such as mono- or polypropylene glycol monoacrylate, mono- or polypropylene glycol monomethacrylate, mono- or polyethyleneglycol monoacrylate or methacrylate and the like; amino group-containing monomer such as dialkylaminoalkyl acrylate or methacrylate, e.g. dimethylaminoethyl methacrylate; epoxy group-containing monomer such as glycidyl acrylate or methacrylate; polymers derived from a monomer having no polar group, for example alkyl esters of unsaturated carboxylic acid monomers such as methyl acrylate or methacrylate, ethyl acrylate or methacrylate, diethyl maleate and the like; and vinyl aromatic monomers such as styrene, methyl styrene, ethyl styrene vinyl naphthalene and the like. These polymers may be derived from the copolymerization of the exemplified monomers and/or others.

Other group of polymers usable in the present invention may be polyesters. Such polyesters may be derived from the esterification of polyols and poly-acids, for example, as polyols there are exemplified diols such as ethyleneglycol, diethylene glycol, triethylene glycol, polyethylene glycol, propylene glycol, dipropyleneglycol, triethylene glycol, polypropylene glycol, 1,4-butanediol, aromatic diols such as p,p'-isopropylidenediphenol (bisphenol A), precursor of diols such as lactones, partially esterified polyols such as fatty acid monoglycerides; triols or tetraols; and addition products of alkylene oxides to aliphatic or aromatic compounds having two or more active hydrogen atoms, such as diols, amines, alkanolamines, dithiols and the like. Most preferable polyols are diols and addition products of ethylene oxide and/or propylene oxide. As the poly-acids there are exemplified di-carboxylic acids, tricarboxylic acids or others. The di-carboxylic acids may include terephthalic acid, isophthalic acid, maleic acid, fumaric acid, itaconic acid, malonic acid, succinic acid, alkylsuccinic acids, glutaric acid pimeric acid, adipic acid, sebacic acid, and the like. As tri-carboxylic acid may include trimellitic acid and the like.

Other groups of the polymers usable as a binder resin of the present invention may include maleic alkyd resin, maleic oil, elastomer resin, for example, resin partially containing diens such as butadiene, isoprene, chloroprene and the like; and epoxy resin and so on.

These polymers may be mixed to give suitable properties as a binder resin.

The binder resins according to the present invention preferably has a melting point of from 80 to 180° C., elasticity of from 100° to 160° C., and glass transition temperature of from 55° to 70° C.

The ratio of the binder resins to the magnetic powders is preferably 100 parts by weight to 200–900 parts by weight. If the magnetic powders are mixed less than 200 parts by weight, sufficient magnetic intensity cannot be effected whereas in case of more than 900 parts by weight obtained binder type carriers become so brittle to be used as a carrier.

In order to prepare the cores (i.e. conventional binder type carriers) to be used in the production of the carrier of the present invention any conventional manner may be used, for example, binder resin is sufficiently mixed with magnetic powders under higher temperature than the melting point of the binder resins, cooled, smashed and sifted to a suitable particle size.

The cores preferably have a particle size of from 20 to 100 micron meter, more preferably 30 to 70 micron meter as a weight average particle size, and a volumetric specific resistance of more than $10^8$ ohm cm, more preferably more than $10^{13}$ ohm cm.

According to the present invention charge controlling agents are firmly adhered on the surface of the cores.

The charge controlling agents may include any inorganic materials or organic materials which can give an electrical charge under friction with a toner, for example, metal oxides such as superfine silica, superfine titanium oxide, superfine alumina and the like; oily dyes containing metal alloy; nigrosine dyes; quaternary ammonium salts; nitrogen-containing cyclic compounds such as imidazols, pyridines or derivative thereof and the like; organic pigments; resinous materials containing fluorine atom, chlorine atom, nitrogen atom and the like.

The particle size of the charge controlling agents may be 0.02 to 15 micron meter, more preferably 0.1 to 10 micron meter, which is preferably 1/1000 to 1/10 of the particle size of non-coated carriers to be covered therewith. The preferable amount of the charge controlling agents is 0.1 to 10 % by weight based on the weight of the cores more preferably 1 to 5 % by weight.

The binder type carriers of the present invention may be prepared by mixing the cores with charge controlling agents in a vessel equipped with an instantaneously heating device and a mixing blade to dust the charge controlling agents on the surface with the cores, and heating the mixture on at least the surface of the cores, for instance, by means of high friction under vigorous mixture or by means of microwave to weld the charge controlling agents on the surface of the cores. A suitable apparatus to adhere the charge controlling agents on the carrier is, for example, Henshel mixer, Hybridizer available from Narakikai Seisakusho K.K. Of course, this method is only an example, but any manners, device or means are applicable to prepare the binder type carriers of the present invention.

The binder type carriers of the present invention may contain other materials which are usually used in a conventional binder type carrier.

The present invention shall be illustrated by the following examples, but it should not be interpreted as restricted by the descriptions of the examples.

Example 1

Synthesis of Binder Resin (1):

Into four necks flask equipped with a thermometer, a stirrer of stainless steel, a condenser and an $N_2$-inlet hydroxyphenyl)propane (490 g), polyoxyethylene(2.2 mol)-2,2-bis(4-hydroxyphenyl)propane (190 g), terephthalic acid (170 g), n-dodecylsuccinic acid (320 g) and dibutyltin oxide (0.05 g), which were heated to 270° C. on a mantle heater under nitrogen atmosphere to allow them to react. When the generation of water had not been observed, trimellitic acid (58 g) was added, and the reaction was continued. When the acid value of the reaction mixture became to 9 (mg KOH/g), the reaction mixture was cooled to stop the reaction. The obtained polyester had an acid value of 9 mg KOH/g, OH value of 16 mg KOH/g, a melting point (Tm) of 124° C., a viscosity ($\eta_{100}$) $3\times10^6$ poise, $-d(\log \eta)/dT$: $4.0\times10^2$, which were determined by a flow tester, and a moisture absorptivity of 0.66 %.

Preparation of Core A:

After following materials described hereinafter were sufficiently mixed, the mixture was blended under heating, cooled, smashed and classified to give the Core A.

| formulation of Core A | parts by weight |
|---|---|
| polyester resin prepared in the above | 100 |
| carbon black (MA #8: available from Mitsubishi Kasei Kogyo K.K.) | 2 |
| silica (Aerosil #200: available from Aerosil K.K.) | 1.5 |
| Zn type-ferrite (max. magnetic intensity: 72 emu/g, Hc: 110, a vol. spec. resistance: $3\times10^8$ Ωcm | 600 |

The average particle size of the Core A is 61 μm

Preparation of Carrier I:

The Core A prepared by the above process (100 parts by weight) and nigrosine dye (Bontron N-01: available from Orient Kagaku Kogyo K.K.) (3 parts by weight) were charged into a Henshel mixer (capacity: 10 liter), stirred at a revolution rate of 2,000 rpm for 2 minutes to uniformly dust the nigrosine all over the Core A. The dusted Core A was dispersed into an air flow heated at 320° C., and held for about 1 to 3 seconds to partially melt the surface of the Core A, and the dye was welded thereon to give a Carrier I.

Example 2

The Core A (100 parts by weight) and metal-containing dye (Bontron S-34: available from Orient Kagaku Kogyo K.K.) (2 parts by weight) were charged into a Henshel mixer (capacity: 10 liter), and blended at a revolution rate of 2,000 rpm for 2 minutes to uniformly dust the dye all over the surface of the Core A.

The dusted Core A was partially heated for 20 minutes at 1,000 rpm to weld the metal-containing dye on the core surface to give Carrier II.

Example 3

Carrier III was obtained by mixing the Core A (100 parts by weight) and colloidal silica (R-972: available from Nippon Aerosil K.K.) (2 parts by weight), stirred and then instantaneously heated according to Example 1.

Example 4

Carrier IV was obtained by mixing the Core A (100 parts by weight) and quaternary ammonium salts (P-51: available from Orient Kagaku Kogyo K.K.) (3 parts by weight), stirred and then instantaneously heated according to the same manner as in the Example 1.

Example 5

Carrier V was obtained by mixing the Core A (100 parts by weight) and nigrosine (Bontron N-01: available from Orient Kagaku K.K.) (0.5 parts by weight), stirred and then instantaneously heated according to the same manner as in the Example 1.

Example 6

Carrier VI was obtained by mixing the Core A (100 parts by weight) and nigrosine (Bontron N-01: available from Orient Kagaku K.K., 10 parts by weight), stirred and then instantaneously heated according to Example 1.

Example 7

Synthesis of Binder Resin (2): Styrene (650 g), n-butyl methacrylate (300 g), acrylic acid (5 g), azobisisobutyronitrile (20 g) and benzene (1000 g) were charged into a four-necks flask equipped with a thermometer, a stirrer of stainless steel, a condenser, and a nitrogen-inlet, and heated at 70° C. on a mantle heater to react under nitrogen circumstances for 6 hours. After the reaction the benzene was removed under reduced pressure to give a solid resin (2), which had an acid value of 39 mg KOH/g, a glass temperature of 62° C., melting point (Tm) of 125° C., and a viscosity (at 100° C.:$\eta_{100}$) of $4\times10^6$ poise and $-d(\log \eta)/dT$ of $3.8\times10^2$ when determined by a flow tester.

Preparation of Core B:

Following components were sufficiently mixed, blended under heating, cooled, smashed and then classified to give Core B.

| Components | parts by weight |
|---|---|
| styrene-acryl resin (2) | 100 |
| carbon black (MA #8: available from Mitsubishi Kasei K.K.) | 2 |
| silica (Aerosil #200: available from Aerosil K.K.) | 1.5 |
| Zn type ferrite (maximum magnetized intensity: 72 emu/g, Hc: 110, vol. spec. resistance: $3\times10^8$ Ωcm) | 600 |

The obtained Core B has an average particle size of 6.3 micron meter.

Preparation of carrier VII:

Core B (100 parts by weight), nigrosine (Bontron N-01: available from Orient Kagaku Kogyo K.K.) (3 parts by weight) were charged into a Henshel mixer (capacity: 10 liter), and mixed at 2,000 rpm for 2 minutes to uniformly dust the nigrosine all over the Core B. The dusted Core B was dispersed in an air flow heated at 320° C., and the surface thereof was partially and instantaneously heated for about 1 to 3 seconds to weld the nigrosine on the surface of the Carrier B to give the Core VII.

Comparative Example 1

The Core A of Example 1 was used as it is as a conventional carrier for the Comparative Example 1.

Comparative Example 2

The Core B prepared in Example 7 was used as it is as a conventional carrier for the Comparative Example 2.

Preparation of Toner:

Hymer SBM 600 (styrene-acrylic copolymer: available from Sanyo Kasei Kogyo K.K.) (100 parts by weight), carbon black (MA #100: available from Mitsubishi Kasei Kogyo K.K.) (5 parts by weight) were sufficiently mixed, blended by a mixer having three rollers, and then finely smashed by a jet pulverizer. The smashed mixture was sifted to fine particles and coarse particles, and obtained toners having a particle size of 5–25 micron meters and an average particle size of 13 micron meters.

Determination of Charge Amount:

Developers were prepared by mixing the toner (3 g) and the carrier (27 g) of each example and comparative example, and then the charge amount of the obtained developers was determined just after each developer was stirred at 120 rpm for 10 minutes. The results were shown in Table 1.

Evaluation of durability against copying:

The durability of the developers prepared from the Carriers I - VII against 60,000 sheets copying was evaluated using Copying Machines EP-470Z and EP-650Z (available from Minolta Camera K.K.). Neither fog was observed in the copied image obtained using the Carriers I–VII, nor stains by the toner on the photosensitive member, whereas with respect to the developer of the Comparative Examples 1 and 2 the charge amount was insufficient to be determined.

TABLE 1

| example | binder resin (100 parts) | charge controlling agents | charge amount (μc/g) | fog |
|---|---|---|---|---|
| 1 | polyester resin | nigrosine (3 parts) (Bontron N-01) | −15 | non |
| 2 | polyester resin | metal-containing dye (2 parts) (Bontron S-34) | +13 | non |
| 3 | polyester resin | colloidal silica (2 parts) R-972 | +12 | non |
| 4 | polyester resin | quaternary ammonium salts (3 parts) P-51 | −12 | non |
| 5 | polyester resin | nigrosine (0.5 parts) Bontron N-01 | −10 | non |
| 6 | polyester resin | nigrosine (10 parts) Bontron N-01 | −16 | non |
| 7 | styrene-acrylic resin | nigrosine (3 parts) (Bontron N-01) | −13 | non |
| Compar. Ex. 1 | polyester resin | non | +2 | — |
| 2 | styrene-acrylic resin | non | −1 | — |

As apparent from the above results, the binder type carriers of the present invention can control the polarity of the charge thereon, plus or minus, by the action of the charge controlling agents, in addition to which the toner used together with the carriers can be sufficiently charged. The copied image produced by the developer containing the carrier of the present invention has no substantial fogs even after durability test of 60,000 sheets.

What is claimed is:

1. A binder type carrier comprising: a core which comprises thermoplastic resin, magnetic powder, and particles of charge controlling agents adhered on the surface of said core; said binder type carrier having a particle size of from 50 to 70 microns.

2. A binder type carrier of the claim 1, in which the thermoplastic resin in a member selected from the group consisting of copolymers of acrylic monomers and styrene, and polyester resins.

3. A binder type carrier of the claim 1, in which the core is formed by dispersing said magnetic powder in said thermoplastic resin.

4. A binder type carrier of the claim 1, in which the particle size of the charge controlling agent is from 0.02 to 15 microns.

5. A binder type carrier of the claim 1, in which the amount of the charge controlling agents adhered on the surface of the core is from 0.1 to 10% by weight based on the weight of the core.

6. A binder type carrier of the claim 1, in which said binder type carrier is obtained by electrostatically dusting the charge controlling agent on the surface of the core, and then adhering the charge controlling agent dusted on the surface of the core by melting the thermoplastic resin.

7. A binder type carrier of the claim 1, in which the charge controlling agent is a member selected from the group consisting of nigrosine dyes, metal-containing dyes and quaternary ammonium salts.

8. A binder type carrier of the claim 1, in which the core has a magnetic property; and the particles of the charge controlling agent are obtained by being electrostatically dusted on the surface of the core and then being thermally adhered to the surface of the core.

9. A binder type carrier of the claim 1, in which the core has a volumetric specific resistance of more than $10^{13}$ ohm cm.

10. A binder type carrier of the claim 1, in which the ratio of the binder resin of the magnetic powder is 100 parts by weight to 200 to 900 parts by weight.

* * * * *